US009666006B2

(12) United States Patent
Kramer et al.

(10) Patent No.: US 9,666,006 B2
(45) Date of Patent: May 30, 2017

(54) WIRELESS RADIO FREQUENCY SWITCH CONTROLLER

(71) Applicants: Mark Kramer, Castle Rock, CO (US); Wilfred Tucker, Centennial, CO (US); John Sample, Centennial, CO (US)

(72) Inventors: Mark Kramer, Castle Rock, CO (US); Wilfred Tucker, Centennial, CO (US); John Sample, Centennial, CO (US)

( * ) Notice: Subject to any disclaimer, the term of this patent is extended or adjusted under 35 U.S.C. 154(b) by 0 days.

(21) Appl. No.: 14/636,975

(22) Filed: Mar. 3, 2015

(65) Prior Publication Data

US 2015/0179011 A1 Jun. 25, 2015

Related U.S. Application Data

(63) Continuation-in-part of application No. 13/607,945, filed on Sep. 10, 2012, now abandoned.

(60) Provisional application No. 61/533,203, filed on Sep. 10, 2011.

(51) Int. Cl.

| | |
|---|---|
| ***G08B 1/08*** | (2006.01) |
| ***G07C 9/00*** | (2006.01) |
| ***G08C 17/02*** | (2006.01) |
| *G08B 13/08* | (2006.01) |

(52) U.S. Cl.

CPC ..... *G07C 9/00896* (2013.01); *G07C 9/00944* (2013.01); *G08C 17/02* (2013.01); *G07C 2009/00928* (2013.01); *G08B 13/08* (2013.01)

(58) Field of Classification Search

None

See application file for complete search history.

(56) References Cited

U.S. PATENT DOCUMENTS

| | | | | |
|---|---|---|---|---|
| 3,934,074 | A | 1/1976 | Evelove et al. | |
| 4,344,252 | A | 8/1982 | Suzuki et al. | |
| 4,675,586 | A | 6/1987 | Eigner et al. | |
| 6,005,210 | A * | 12/1999 | Chien | H01H 1/585 200/14 |
| 6,177,884 | B1 | 1/2001 | Hunt et al. | |
| 6,346,889 | B1 * | 2/2002 | Moss | E05F 15/79 340/545.1 |
| 6,980,117 | B1 | 12/2005 | Kirkland et al. | |

(Continued)

*Primary Examiner* — Brian Zimmerman
*Assistant Examiner* — Kevin Lau
(74) *Attorney, Agent, or Firm* — Gearhart Law LLC

(57) ABSTRACT

A wireless radio frequency switch controller may be capable of being retrofit on to any existing parent system such as a thermostat, security system, garage door, and the like. The switch controller may have an external housing, a contact penetrating clip, a processor capable of being connected to a network, and a computer readable storage medium storing one or more programs for execution by the processor. The bottom of the contact penetrating clip preferably has at least one cutting surface. The cutting surface being capable of cutting an insulative covering for an electrical wire, once the contact penetrating clip is secured to the switch controller. The switch controller requires no batteries and harvests/stores energy from the parent system's existing wiring. The switch controller may be capable of being paired with a wireless receiver/transceiver by which the operation of the switch controller and subsequently the parent system may be manipulated.

20 Claims, 7 Drawing Sheets

(56) References Cited

U.S. PATENT DOCUMENTS

| | | | | |
|---|---|---|---|---|
| 6,980,122 | B2 * | 12/2005 | Novikov | H05B 39/086 307/36 |
| 7,397,342 | B2 | 7/2008 | Mullet et al. | |
| 7,602,283 | B2 * | 10/2009 | John | G08B 21/14 340/539.11 |
| 7,701,331 | B2 | 4/2010 | Tran | |
| 7,750,890 | B2 | 7/2010 | Fitzgibbon et al. | |
| 7,778,604 | B2 | 8/2010 | Bauman et al. | |
| 7,884,701 | B2 | 2/2011 | Tsui et al. | |
| 7,956,718 | B2 | 6/2011 | Murphy et al. | |
| 2003/0026599 | A1 * | 2/2003 | Fitzgibbon | H02P 7/28 388/800 |
| 2003/0043021 | A1 | 3/2003 | Chung | |
| 2003/0056966 | A1 * | 3/2003 | Mori | H05K 5/00 174/559 |
| 2004/0239482 | A1 | 12/2004 | Fitzgibbon | |
| 2005/0012631 | A1 | 1/2005 | Gregori et al. | |
| 2005/0184854 | A1 * | 8/2005 | Mullet | G07C 9/00182 340/5.22 |
| 2005/0253710 | A1 * | 11/2005 | Eskildsen | G08B 13/08 340/545.5 |
| 2005/0287863 | A1 * | 12/2005 | Tufano | H01R 4/2404 439/418 |
| 2008/0132220 | A1 | 6/2008 | Fitzgibbon | |
| 2009/0156126 | A1 | 6/2009 | Willis | |
| 2010/0301999 | A1 * | 12/2010 | Carlson | G07C 9/00182 340/5.71 |
| 2011/0032073 | A1 | 2/2011 | Mullet et al. | |
| 2011/0172885 | A1 | 7/2011 | Fawaz et al. | |

* cited by examiner

WIRELESS RADIO FREQUENCY SWITCH CONTROLLER

CLAIM OF PRIORITY

This application claims priority to U.S. application Ser. No. 13/607,945 filed on Sep. 10, 2012 which claims priority to U.S. Application 61/533,203 filed on Sep. 10, 2011, the contents of both of which are herein fully incorporated by reference in its entirety.

FIELD OF THE EMBODIMENTS

The field of the present invention and its embodiments relate to a wireless radio frequency switch controller and a method of using the described invention, namely a wireless frequency switch controller which is used to operate a movable barrier such as a garage door. In particular, the present invention enables one to retrofit the present invention to an existing system thus enabling wireless and/or automated control over the barrier.

BACKGROUND OF THE EMBODIMENTS

Various garage doors and other artificial, electronically controlled barriers have been used for many years to protect the owner's contents therein or to restrict access to an area beyond the barrier. Such barriers are capable of providing a security measure against the outside world and are typically accessible only to those who possess the mechanism or means to operate the particular system.

Generally, a method of controlling these barriers can achieved by a remote radio frequency controller which, in turn, interacts with a receiver that is adapted to receive a wireless command signal from a transmitter. However, problems arise when the controller, which is battery operated, no longer functions. This is due to the depletion of the power source and necessitates the purchase and/or replacement of the power source. Power sources, such as batteries cost money and are not easy to dispose, nor are they environmentally friendly. With the push to be more environmentally friendly in the context of technology; there is a problem for which a solution is desirable.

In addition, various "universal" opening mechanisms consisting of generally a receiver and transmitter require undue labor in installation such a system and further maintaining that system. A receiver must be operably connected to the mechanism by which the door operates (i.e. opens and/or closes) or installed elsewhere nearby. This need for proximity problem poses a number of issues including but not limited to the height and placement of these operating mechanisms residing outside the reach of most individuals. Most often, a ladder or other means, and other proper tools are required for proper installation and maintenance. When such tools are not readily accessible, the individual must have another person such as a service contractor perform the installation which invariably ends up costing the customer a substantial increase in expenditures.

Further, there is a need for such a universal mechanism that can function with a variety of parent systems, not simply with garage doors. For example, the same mechanism and/or device should be able to work with a variety of parent system to which it can be retrofit such as a thermostat, security system, doorbell, motion detector, smoke detector, light detector, carbon monoxide detector, or natural gas detector, or any combination thereof. Such a mechanism should be able to log the usage of each of these systems and various other characteristics as need through pre-installed and/or downloadable software.

Various devices are known in the art. However, their property and means of operation are substantially different from the present disclosure. The other inventions fail to solve all the problems taught by the present disclosure. The present invention and its embodiments requires no battery as it harvests energy from existing wiring in the parent system. Further, the device may be retrofit to virtually any system negating the need for costly and time consuming installs. At least one embodiment of this invention is presented in the drawings below and will be described in more detail herein.

SUMMARY OF THE EMBODIMENTS

Generally, the present invention and its embodiments solves these problems described herein and others not explicitly stated by using an apparatus that fits and works with an existing system with no need for undue manual installation, the use of hand tools, or requirement of a service contractor. In addition, the system is battery free, making it more cost effective and the safer for the environment.

In one embodiment of the present invention there is an apparatus having an external housing with at least a first section and a second section and being configured to guide and/or position at least one electrical wire; a contact penetrating clip having at least a top surface and a bottom surface and being capable of being removably coupled to the external housing, wherein the bottom surface of the contact penetrating clip has at least one cutting surface, wherein once the contact penetrating clip is coupled to the external housing, the at least one cutting surface cuts a insulative coating of the at least one electrical wire; a processor capable of being connected to a network; and a computer readable storage medium storing one or more programs for execution by the processor.

In another embodiment of the present invention there is a system for opening and/or closing a barrier, the system comprising: an apparatus having an external housing having at least a first section and a second section and being configured to guide and/or position at least one electrical wire, a contact penetrating clip having at least a top surface and a bottom surface and being capable of being removably coupled to the external housing, wherein the bottom surface of the contact penetrating clip has at least one pusher, wherein once the contact penetrating clip is coupled to the external housing, the at least one pusher positions the at least one electrical wire to have an insulative coating of the at least one electrical wire cut by a cutter operably coupled to the apparatus thereby establishing an electrical connection between the apparatus and the at least one electrical wire, a processor capable of being connected to a network, a computer readable storage medium storing one or more programs for execution by the processor; at least one barrier capable of being positioned in an open and/or closed position, wherein the at least one barrier is capable of being controlled by the apparatus; and at least one electronic device capable of establishing a wireless connection with the apparatus, wherein the apparatus is capable of sending alerts to the at least one electronic device, and wherein the electronic device is capable of sending a first signal to the apparatus thereby causing the a change in the state of the barrier. In some embodiments, a remote monitoring apparatus may be coupled directly to the barrier to provide enhanced monitoring of the barrier.

In yet another embodiment of the present invention there is a method of using an apparatus as described herein, the method comprising the steps of: placing an apparatus between at least one electrical wire and a coupling surface; positioning the at least one electrical wire in at least one dummy wire post; depressing and securing a contact penetrating clip to the apparatus, wherein the depressing and securing of the contract penetrating clip cuts an insulative material covering the at least one electrical wire causing the apparatus and at least one electrical wire to establish an operable electrical connection; and sending a first signal to the apparatus, wherein the first signal causes the apparatus to activate a first response of a device operably coupled to the at least one electrical wire.

According to one aspect of the present invention, there is a Bluetooth® low energy device (wireless receiver/transceiver) that operates in conjunction with the apparatus once operably coupled to one another. The apparatus generally an external housing, the external housing further having a mechanism for mounting of a printed circuit board (PCB) therein. In addition, the external housing has at least one contact penetrating clip. The apparatus may also have an internal real time clock, at least one light source which may be a light emitting diode (LED), organic light emitting diode (OLED), or quantum dot LED, and at least one depressible switch. The internal real time clock permits the electronic opening or closing of a garage door or barrier at predetermined times, and can time stamp the position of the door/barrier at any given time. Additionally, an accelerometer may be placed on the existing barrier (i.e. garage door) to further assist in logging movements of the barrier and potentially even diagnosing uneven movements possibly signifying mechanical failure(s).

The apparatus is capable of being quickly coupled to the existing wiring of the garage door or other parent system and is substantially operational from that point forward. The programmed software automatically determines the polarity of the signal and ground of the existing wiring. The apparatus may further measure a motor voltage change over a low volt direct current wiring of the barrier. The Bluetooth® low energy device or other receiver/transceiver (i.e. electronic device) may operate in wireless communication with the apparatus. When the apparatus is desired to cause the barrier to open or close or the like, electrical energy stored in the capacitors contained within the apparatus is used in small bursts when one attempts to interact with an embodiment of the present invention, thereby opening and closing the existing door as required. The stored electrical energy is "harvested" from the existing wiring of which the apparatus is in operable connection.

A general method of using a wireless radio frequency switch controller comprises attaching an external housing to existing garage door wiring, and depressing the contact penetrating clip(s) into the existing garage door wiring. From there, one may send a first signal, for example an industrial, scientific, medical (ISM) radio signal, to the apparatus. The ISM signal may be a Bluetooth® low energy, ANT®, or ZigBee® protocol, or the like or any combination thereof preferably implementing at least 128-bit security encryption.

In other aspects of the present invention, the present invention functions as described herein but rather in conjunction with another parent apparatus such as a thermostat, security system, garage door, doorbell, motion detector, smoke detector, light detector, carbon monoxide detector, or natural gas detector, or any combination thereof, or other system not named that operates over a range of about 6Vdc to about 40Vdc.

These and other embodiments will be better understood in conjunction with the drawings and descriptions that follow.

In general, the present invention succeeds in conferring the following, and others not mentioned, benefits and objectives.

It is an object of the present invention to provide an apparatus that is capable of being retrofit to any existing system.

It is an object of the present invention to provide an apparatus requires no battery.

It is an object of the present invention to provide an apparatus is capable of being paired with a wireless communication device.

It is an object of the present invention to provide an apparatus that logs usage of the system to which the apparatus has been coupled.

It is an object of the present invention to provide an apparatus that is capable of controlling the existing system to which it has been retrofit.

It is an object of the present invention to provide an apparatus that can be manually manipulated to cause a change in the parent system.

It is an object of the present invention to provide an apparatus that saves the consumer time and money.

BRIEF DESCRIPTION OF THE DRAWINGS

Embodiments of the invention will now be described, by way of example, with reference to the accompanying drawings, in which.

DESCRIPTION OF THE PREFERRED EMBODIMENTS

Figure 1:
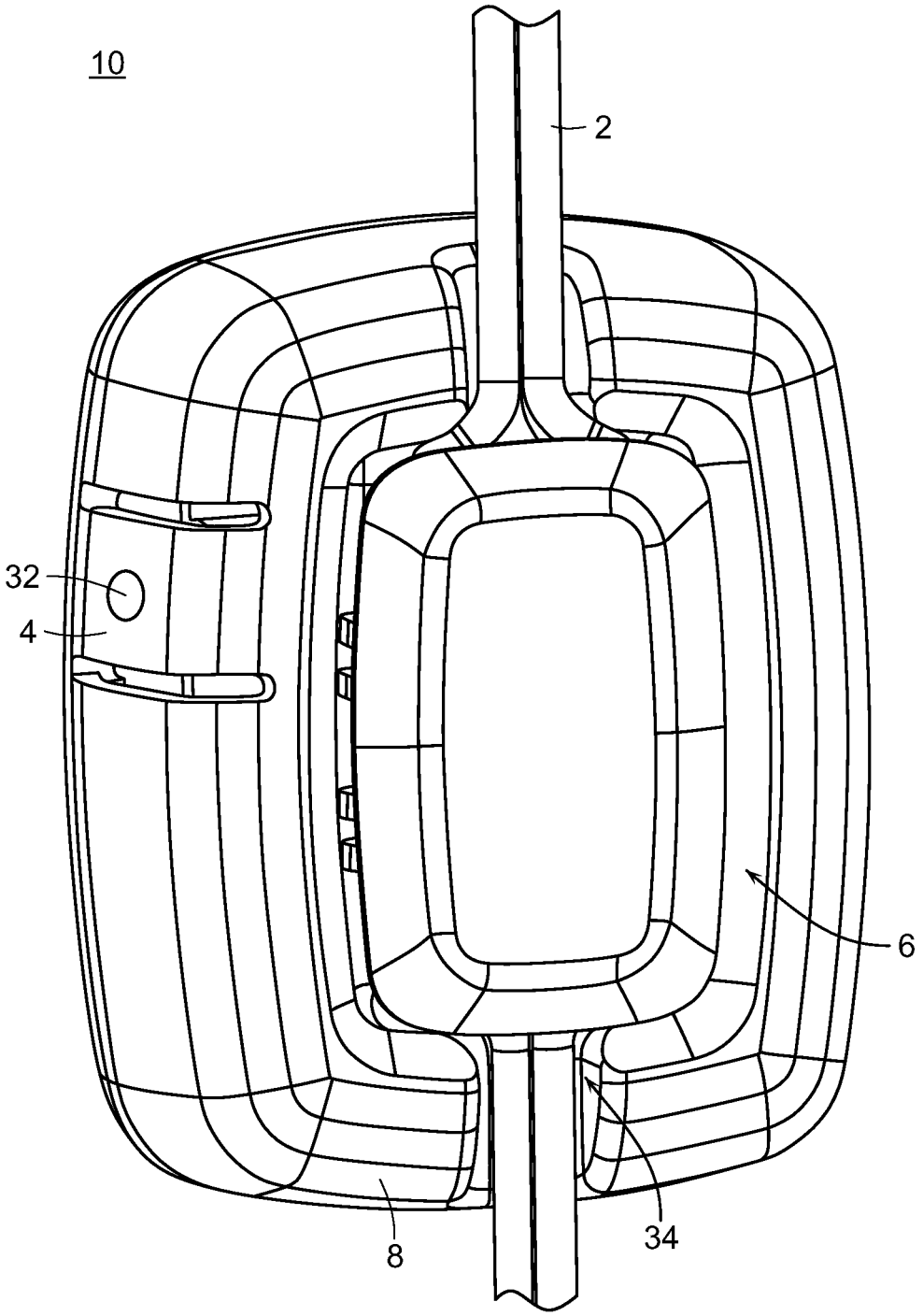
FIG. 1 is a perspective view of one embodiment of the present invention in one intended usage.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIG. 1, there is one embodiment of the present invention shown as installed in one intended usage on a coupling surface such as a wall, beam, or the like (not shown). The apparatus 10 generally has an external housing 8 that comprises at least a first section and a second section (see FIGS. 2 and 3) and is sized to fit underneath at least one and preferably two electrical wires 2.

The electrical wires 2 are preferably a signal wire, or a wire which carries a data transmission, and a ground wire, or a wire which typically provides some type of direct physical connection to a the Earth or ground or even may be a common. The electrical wires 2 are held in place by the guide channels 34 which are preferably located at a first position and a second position (i.e. top and bottom) on the apparatus 10. Once positioned, the apparatus 10 can be coupled to the coupling surface via the crew mount 30 as shown in FIG. 2.

A contact penetrating clip 6 is positioned over the electrical wiring 2 and using coupling mechanisms (see FIGS. 5 and 6) secured thereto. A depressible button 4 is located on some surface of the external housing 8 and may be integrated with the external housing 8. The depressible button 4 can be used to operate the garage door manually from the apparatus 10. In some instances, the depressible button 4 may be illuminated by a light source 32 such as a light emitting diode, organic light emitting diode, or quantum dot light emitting diode or the like or any combination thereof.

Figure 2:
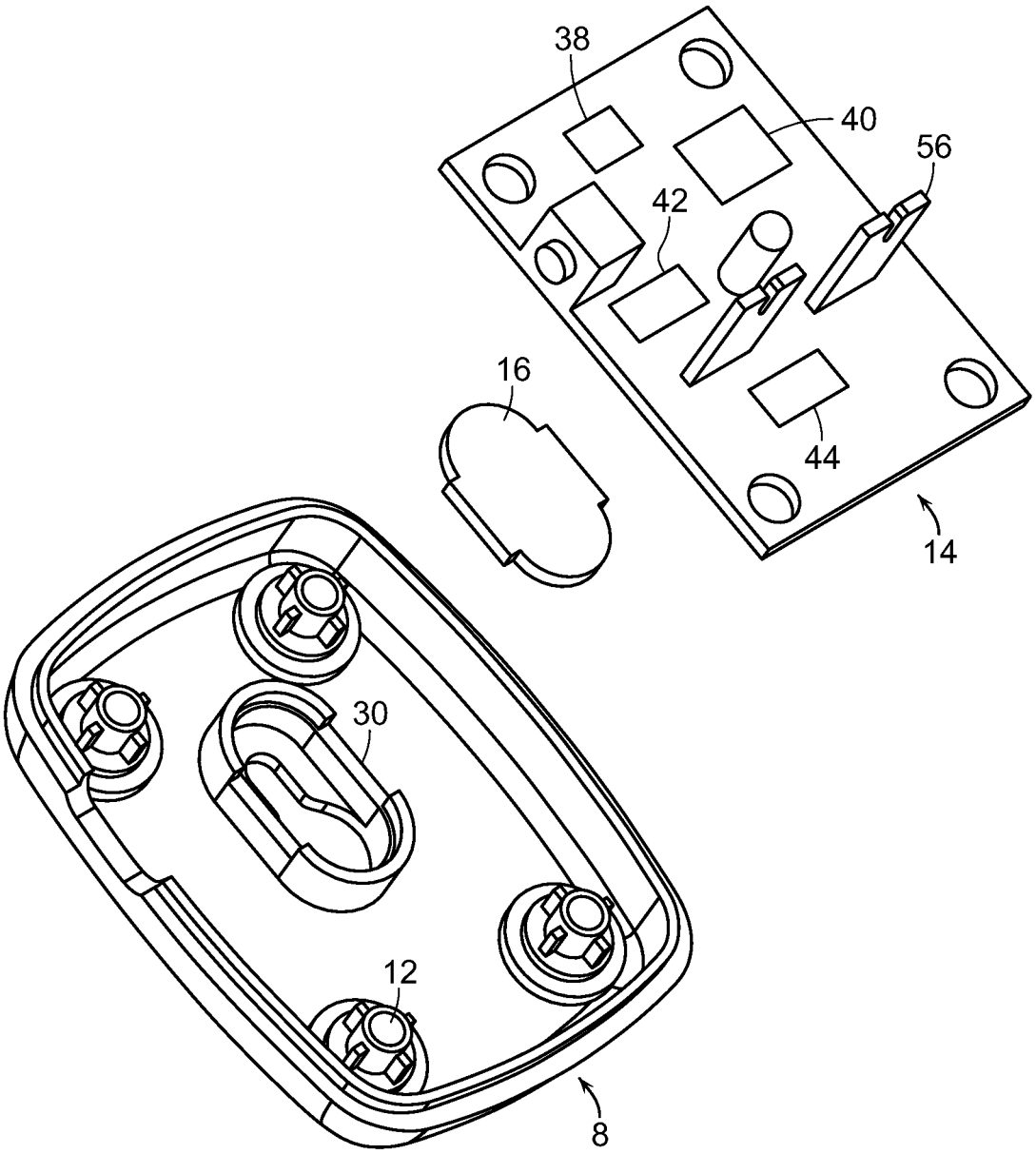
FIG. 2 is an exploded view illustrating various internal components of an embodiment of the present invention.

In FIG. 2, one of the sections (to be mounted on the coupling surface) of the external housing 8 is visible detailing the internal structures of the interior of the external housing 8. This section of the external housing 8 generally has a crew mount 30 and any number of ribbed mounting boss(es) 12. A crew mount cover 16 fits into the crew mount 30 and a printed circuit board (PCB) 14 is coupled to the ribbed mounting bosses 12.

The crew mount 30 allows the external housing 8 to be securely attached to a coupling surface such as a wall. The crew mount 30 is shaped as a generally circular opening with a narrower semi-circular extension coupled and providing access thereto. The crew mount 30 can thus receive numerous sized coupling mechanisms such as nails, screws, tacks, pins, and the like or any combination thereof to affirmatively affix the external housing 8 to the coupling surface.

The crew mount cover 16 bears a substantially similar shape to that of the crew mount 30. In addition, the crew mount cover 16 may have tabs that allow it to rest above the coupling mechanism used to secure the position of the external housing 8. This provides protection for the coupling mechanism while providing sufficient room for the coupling mechanism to reside therebelow.

The printed circuit board (PCB) 14 fits onto the ribbed mounting bosses 12 thereby securing the position of the PCB 14. The PCB 14 can further be used to lock or otherwise secure the position of the crew mount cover 16 once the PCB 14 is positioned within the external housing 8. The PCB 14 has a number of features that direct the functionality of the apparatus as a whole.

For example, the PCB 14 should provide at least a transceiver 38, processor, 40, memory 42, and at least one capacitor 44. The transceiver 38 enables wireless transmission and reception of signals sent via a variety of wireless protocols preferably in the 2.4 GHz ISM band. The processor 40 and memory 42 enable the implementation and execution of programming stored thereon. Further the memory 42 enables storage and logging of usage of the parent system and other changes in the parent system's operative state. The at least one capacitor 44 is used to store electrical energy from the existing wiring to use in small "bursts" when a user attempts to interact with an embodiment of the present invention Such energy may be used to operate the apparatus of any part thereof. This enables the present invention to operate without the need for a battery or other externally located power source.

Further, the PCB 14 should provide for cutters 56 which reside thereon and pass through slots 58 (see FIG. 4) once the apparatus is fully assembled. The cutters 56 are operably coupled to the PCB 14 on one end and have a cutting surface sized and shaped to receive the electrical wiring. When the insulative covering of the wiring contacts these cutters 56, the insulative covering is cut, thereby allowing the cutters 56, which are comprised of a conductive material, such as a metal, to establish an electrical connection with the existing wiring. The apparatus can then utilize the electrical energy in the existing wiring to not only power the apparatus but to send signals (i.e. open or close the barrier) to the system as a whole. The cutters 56 interact with the structures of the contact penetrating clip (see FIGS. 5 & 6) to achieve this functionality.

Figure 3:
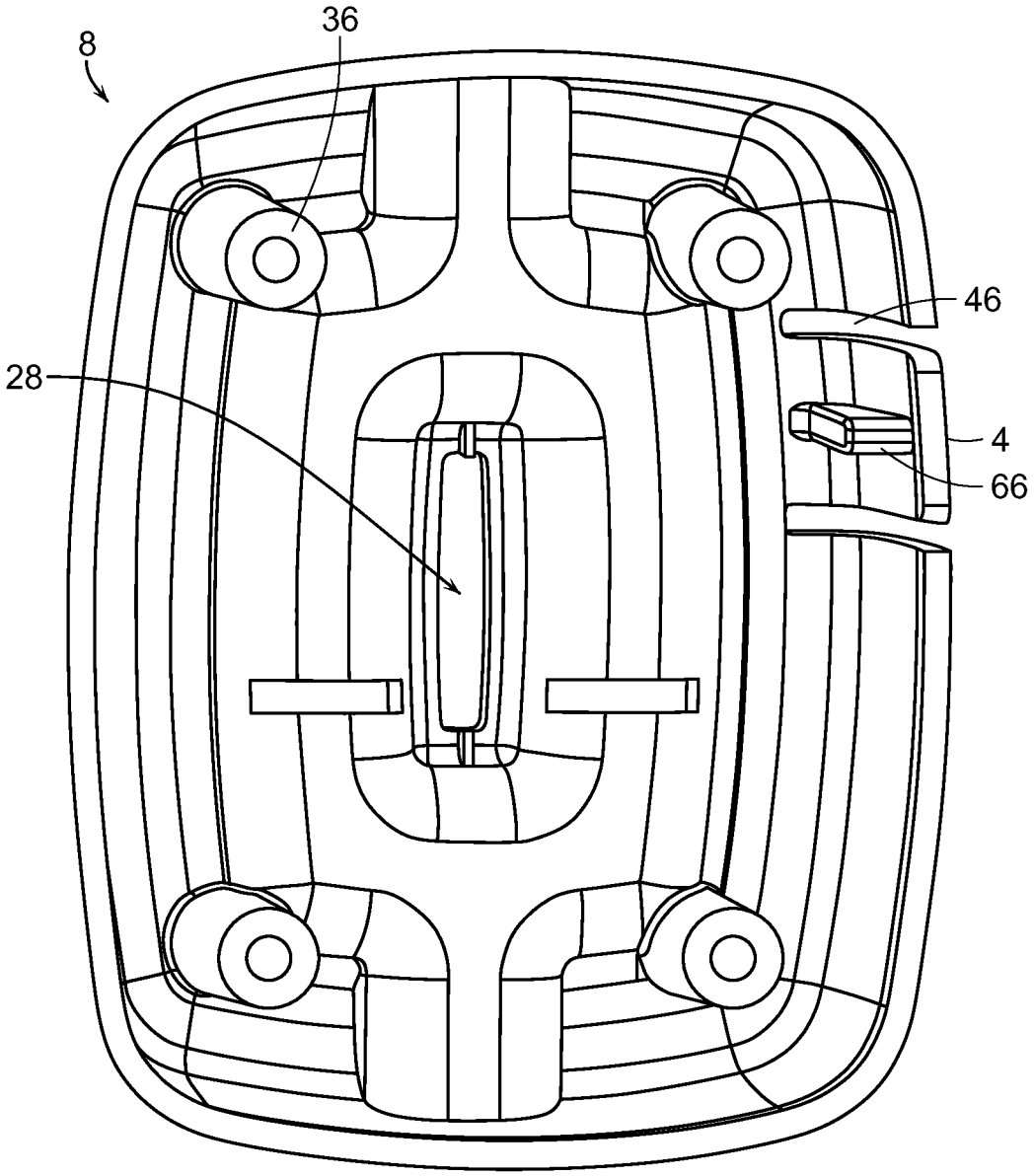
FIG. 3 is bottom view of a top section of the external housing of an embodiment of the present invention.

The upper half of the external housing 8 is shown from a bottom or underside view in FIG. 3. From this view, it can be ascertained as to how the sections of the external housing 8 are secured. The mounting posts 36 are preferably symmetrically located along an interior surface of the external housing 8 and may be in any configuration other than what is shown. The mounting posts 36 are sized to join with the ribbed mounting bosses 12 (see FIG. 2) to hold external housing 8 together in a single unit.

Further, as can be seen the depressible button 4 has an actuator rib 66 which serves to interface with the corresponding structure coupled to the printed circuit board. This serves to limit the flexing or force of depression to be application to the depressible button 4 in order to cause the intended functionality to occur. Further, relief cuts 46 facilitate the movability or flexion provided to the depressible button 4. The light pipe opening 28 is shown as an aperture providing for light entry into the interior of the external housing 8. There may be a singular light pipe opening 28 or there may be multiple light pipe openings 28 in various shapes, sizes, and configurations.

Figure 4:
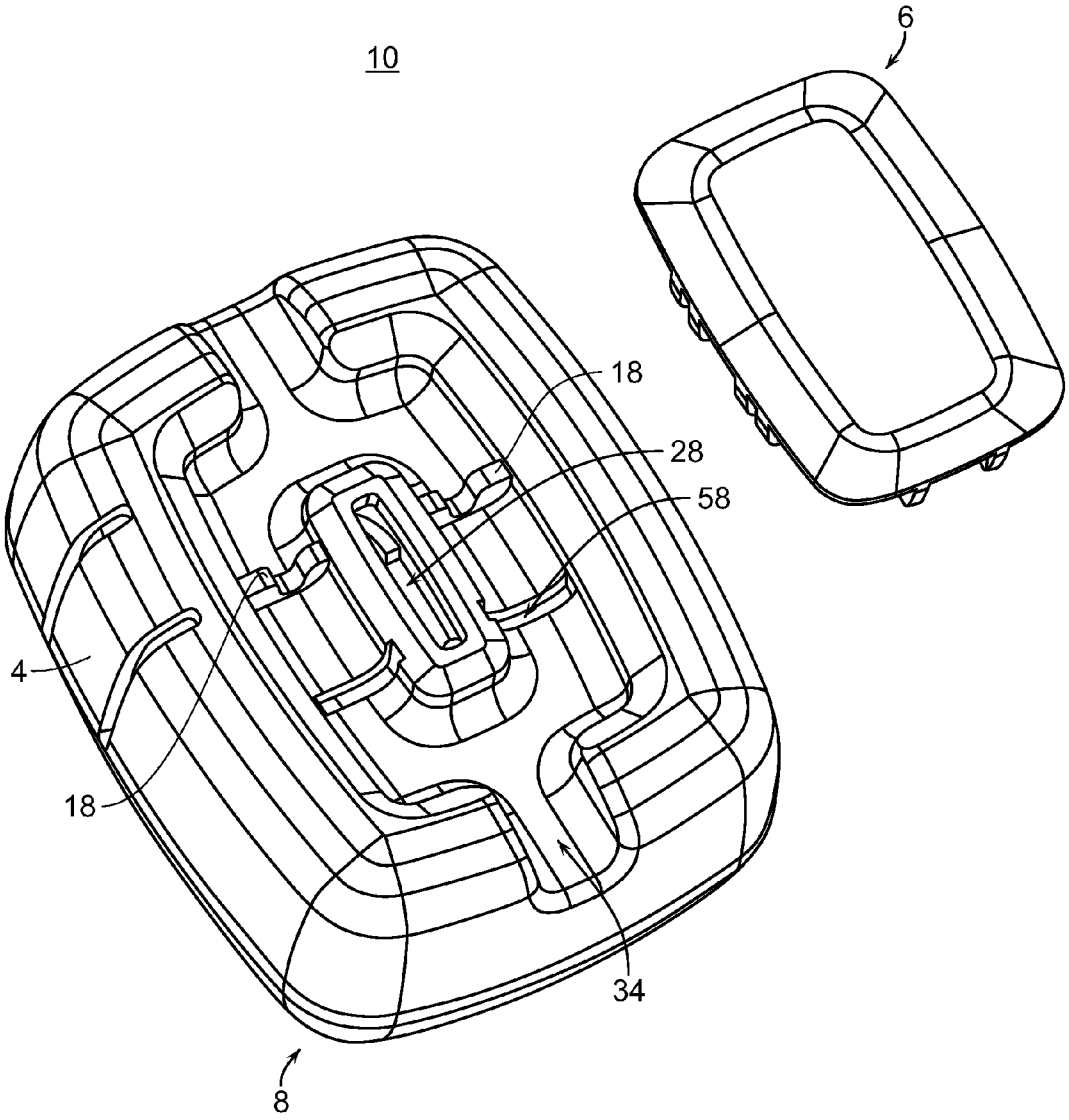
FIG. 4 is a perspective top view of an embodiment of the present invention with the contact penetrating clip removed.

Referring now to FIG. 4, there is a top perspective view of the section of the external housing 8 shown in FIG. 3 with the corresponding section shown in FIG. 2 coupled thereto. Here, with the contact penetrating clip 6 removed, the dummy wire posts 18 are visible. The dummy wire posts 18 hold the electrical wires in place when placing the contact penetrating clip 6 into place such that the wires do not shift resulting in an improper positioning. Further, structures of the apparatus 10 can be seen such as the depressible button 4, guide channels 34, and light pipe opening 28.

The guide channels 34 as shown are channels or grooves present in the outer surface of the external housing 8. The guide channels 34 have entrance points that enables the electrical wiring to lie substantially flat as they pass over the apparatus 10. Along each of the guide channels 34 is at least one dummy wire post 18. The dummy wire posts 18 are essentially "c" shaped clips that allow the electrical wires to be held therein. The shape, size, and location of the dummy wire posts 18 may vary as required.

The light pipe opening 28 provides a mechanism for which illumination from the at least one light source (see FIG. 1) can be directed. The light may illuminate certain areas or features of the apparatus 10. This enables the light source to be, in some instances, coupled directly to the printed circuit board. The shape of the light pipe (see FIG. 5) is integral to its functionality in this implementation.

Further, the external housing 8 provides for slots 58 that permit the cutters 56 (see FIG. 2) to pass therethrough. The number, shape, and size of the slots 58 is typically largely dependent on the requirements for the cutters to effectively pass therethrough and cut the insulative covering of the wiring.

Figure 5:
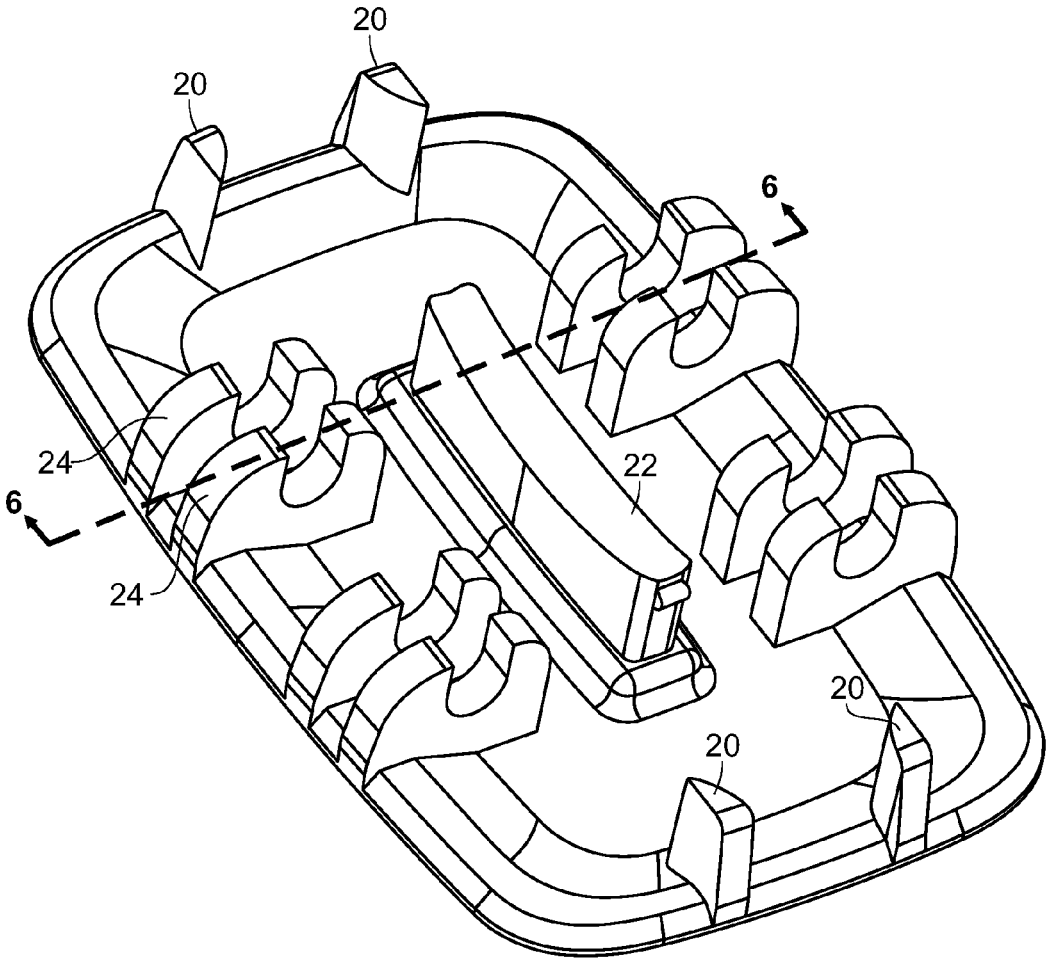
FIG. 5 is a perspective bottom view of the contact penetrating clip.

In FIG. 5, there is a bottom view of the contact penetrating clip 6. The underside or bottom of the contact penetrating clip 6 contains the structural features to facilitate the functionality of the apparatus. Generally, the contact penetrating clip 6 has wire guides 20, wire clips 24, a light pipe 22, and pushers 26 (see FIG. 6).

The wire guides 20 help guide the existing electrical wiring as it enters or exits the external housing. The wire guides 20 are posts that have both a convex surface and a substantially flat surface. The electrical wires are gently curved inwards by the convex surface to align the wires with the guide channels shown in FIG. 4. Thus, when the contact penetrating clip 6 is applied to the apparatus, the wire guides 20 ensure the proper positioning and placement in conjunction with the guide channels.

The wires may be further secured by wire clips 24. These wire clips 24 are aligned in groups, preferably in groups of two, with at least two groups being positioned along each side of the light pipe 22. The light pipe 22 has at least a top and a bottom. The bottom of the light pipe 22 is preferably convex in shape. This shape allows the light to be directed as necessary and namely may provide/direct light to certain features of the apparatus. Each of the at least two sets of two wire clips 24 are designated for each of the at least two electrical wires. Pushers 26 reside between each of the wire clips 24 in each se of wire clips 24 (see FIG. 6).

Figure 6:
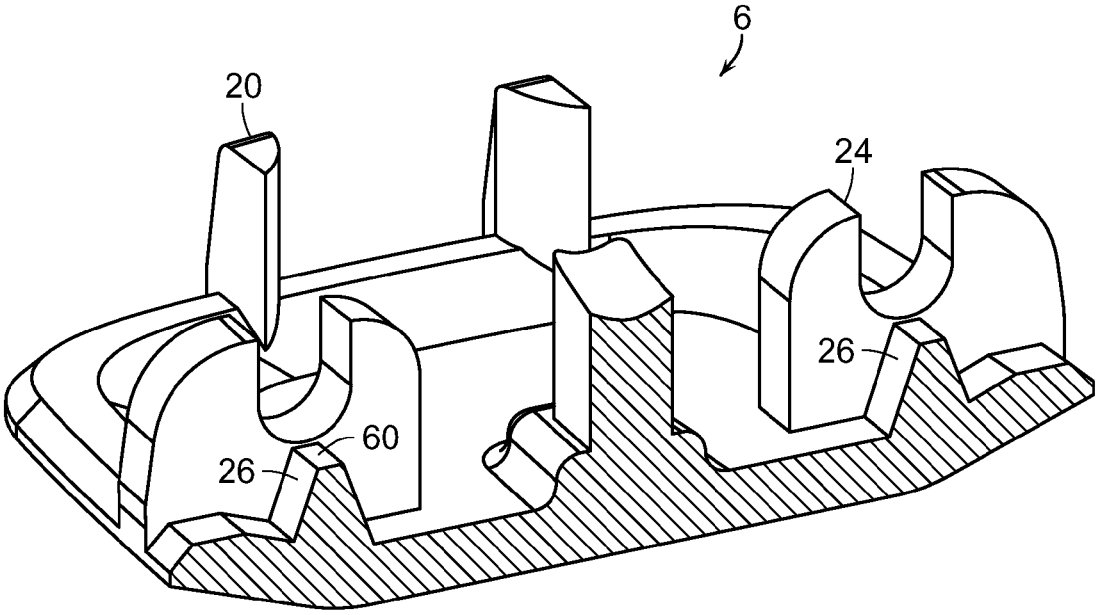
FIG. 6 is an enlarged cross-sectional view taken along line 6 as shown in FIG. 5.

Referring now to FIG. 6, there is a view taken along line 6 of FIG. 5 that demonstrates the structure and functionality of the pushers 26. Here, the convex nature of the wire guides 20 is apparent, which provides for a smooth surface for the electrical wires to be gently manipulated. The wires are positioned and retained by the wire clips 24. The wire clips 24 are generally "c" shaped and are narrower towards the top end or opening of the clip and wider to receive the wire towards the bottom or rounded area of the wire clip 24. This facilitates the retainment of the electrical wire therein.

The pushers 26 are located between any of the sets of wire clips 24 as shown in FIG. 5. The pushers 26 are structures which rise above the bottom surface of the contact penetrating clip 6 and terminate at about the same height as the bottom or rounded area of the wire clip 24. The pushers 26 are generally trapezoidal in shape and have a flat top 60. This flat top 60 ensures there is an adequate surface area to interact with the electrical wires.

Further, this flat top 60 facilitates the positioning of the electrical wires by "pushing" the wires into the cutters 56 residing on the PCB (see FIG. 2). The pushers 26 do not allow the wire to bend or flex towards the bottom side of the contact penetrating clip 6 when the clip is being depressed. Such a bending or flexing would result in the cutting surface of the cutters not being able to penetrate the insulative covering of the electrical wires. The pushers 26 ensure the position of the wires and provides a surface which enables the cutters to effectively cut through the wires insulative covering thereby "tapping" into the electrical energy therein. This, in turn, powers the apparatus.

Figure 7:
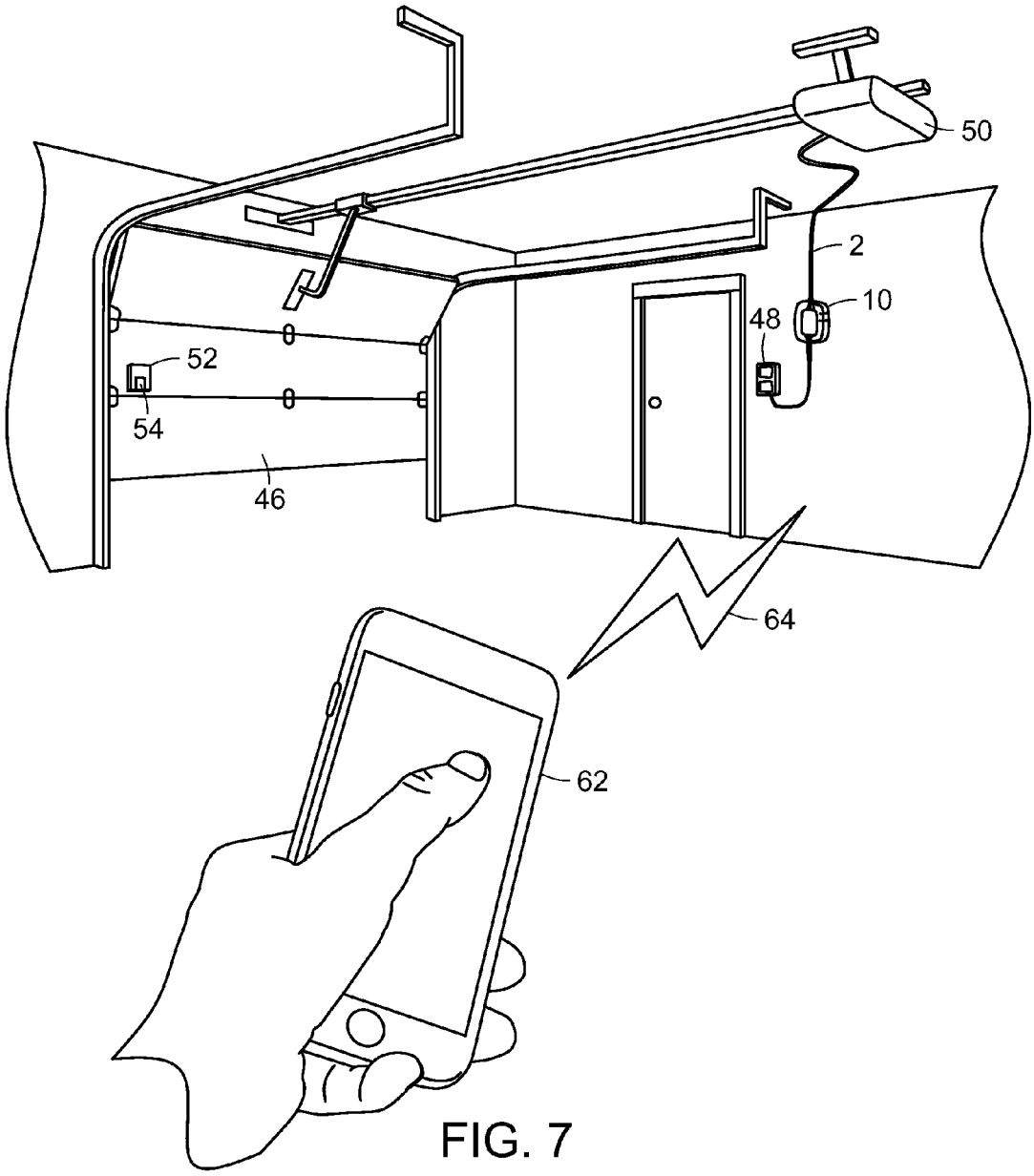
FIG. 7 is an illustration of an example of an embodiment of a system of the present invention.

Referring now to FIG. 7, there is an illustration of one implementation of the present invention in a barrier control system. Generally, a barrier 46 such as a garage door or other repositionable barrier resides on a track and is operably coupled to an existing control system 50. Electrical wiring 2 operably coupled the existing control system 50 with a controller 48. The controller 48 typically has a depressible button that enables the barrier to be operated (i.e. opened or closed). The apparatus 10 as described herein may be coupled to the existing control system 50 to enable wireless control of the system as a whole, as well as facilitate logging and wireless monitoring of barrier activity.

Generally, a method of installation of the apparatus 10 is achieved by securing the apparatus 10 to the existing electrical wiring 2. This can be done at any point along the path of the wiring 2 and is preferably done at eye level or within reasonable reach for manual operation if need be (i.e. depression of the depressible button to operate barrier). The apparatus 10 is placed underneath this wiring 2 with the contact penetrating clip removed and the guide channels facing upwards to receive the wires.

The wiring is placed in the guide channels and their position is secured by the dummy wire posts. The contact penetrating clip is snapped into place over the existing wiring 2. The pushers enables the cutters to cut the insulative covering of the wiring and establish an operable connection with the existing wiring. The present invention is now installed and is ready to interact with dedicated transceiver or similarly situated (i.e. Bluetooth®) wireless device 62. The installed software residing on the apparatus 10 is capable of automatically determining the polarity of the ground and signal wiring further streamlining the installation process and operation. The wireless device 62 may be any number of devices including but not limited to tablets, desktop computers, laptop computers, gaming systems, smart phones, smart watches, multimedia players, and the like or any combination thereof. Mobile or web applications may be run on any of the wireless devices 62 which provide for a variety of functionality, sending/receiving of data, and storage of data associated with the apparatus 10 and its use thereof.

In operation, the electronic device 62 is capable of sending a first signal 64 capable of being received by the transceiver of the apparatus 10. This first signal 64 (and any other signal implemented in the system) may be an industrial, scientific, and medical (ISM) band signal and may be a Bluetooth® low energy, ANT®, or ZigBee® protocol, or the like or any combination thereof preferably implementing at least 128-bit security encryption. This first signal 64 may cause the barrier to open or close as directed by the software interface present on the electronic device 62 and stored on the apparatus 10. Other functionality may include "locking" or preventing the barrier from operation, sending operational reports, automatically opening or closing the barrier once the electronic device 62 is within a predetermined proximity, and opening or closing the barrier at preset times or time intervals throughout a day, week, month, etc. Such time operating functions are achieved via an internal real time clock of the apparatus 10 and may be programmed from the electronic device 62 and/or web/mobile application.

All information described above is capable of being stored on the apparatus' memory and sent to the electronic device 62 employed by the user. This enables one to verify and check each time the barrier 46 has been in use and verify that is it functioning correctly if it is to operate on a predetermined schedule. The user may interact with this information, as noted, via a web and/or mobile application that runs on the electronic device 62. The interface may further, as described, allow the user to manipulate various settings such as alert notification, scheduling of usage, manner of communication (i.e. email, SMS, etc.), monitoring of usage, and the like or any combination thereof.

Further, in some manners of operation there is a remote monitoring apparatus 52 having at least one accelerometer 54 operably coupled to the system. The remote monitoring apparatus 52 is preferably coupled directly to the existing barrier 46. The remote monitoring apparatus 52 can, via the accelerometer 54, ascertain when the barrier 46 may be manually operated or attempted to be manipulated absent the control system 50 or apparatus 10. This is important because it can signify instances of potential theft or someone attempting to gain access to the area for various reasons by bypassing the logging and monitoring of usage by the apparatus 10.

The remote monitoring apparatus 52 therefore should have a battery or other alternative power source and a transceiver capable of communicating with both the apparatus 10 and the electronic device 62. This enables for real time alerting of movements of the barrier 46 absent the control system 50 or apparatus 10 and can permit one to investigate the cause of the movements or vibrations logged by the accelerometer 54.

Additionally, the accelerometer 54 may register and log uneven or undesired movements of the barrier 46 when in used. The remote monitoring apparatus 52 may then be able to communicate with the apparatus 10 or directly with the electronic device 62 to alert a user to this perceived issue as such movements may signify impediments or mechanical failures with the control system as a whole.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. An apparatus comprising:

an external housing having at least a first section and a second section, the external housing having a channel entrance and a channel exit with a first channel and a second channel defined therebetween, wherein the first channel is configured to receive a first electrical wire therein and the second channel is configured to receive a second electrical wire therein;

a contact penetrating clip having a top surface and a bottom surface with the bottom surface having at least two sets of wire clips with each of the at least two sets of wire clips having at least one pusher located therebetween, the contact penetrating clip being capable of being removably coupled to the external housing, wherein once the contact penetrating clip is coupled to the external housing, the at least one pusher positions the first electrical wire and the second electrical wire to have an insulative coating of the first electrical wire and the second electrical wire cut by a cutter operably coupled to the apparatus thereby establishing an electrical connection between the apparatus and the first electrical wire and the second electrical wire;

a processor capable of being connected to a wireless network; and a computer readable storage medium storing one or more programs for execution by the processor.

2. The apparatus of claim 1 further comprising a depressible button.

3. The apparatus of claim 1 further comprising at least one light source.

4. The apparatus of claim 1 further comprising at least one light pipe having a top and a bottom traversing at least a portion of the external housing.

5. The apparatus of claim 4 wherein the bottom of the light pipe is convex in shape.

6. The apparatus of claim 1 further comprising an internal real time clock.

7. A system for opening and/or closing a barrier, the system comprising:

an apparatus comprising, an external housing having at least a first section and a second section, the external housing having a channel entrance and a channel exit with a first channel and a second channel defined therebetween, wherein a first electrical wire resides in the first channel and a second electrical wire resides in the second channel;

a contact penetrating clip having at least a top surface and a bottom surface with the bottom surface having at least two sets of wire clips with each of the at least two sets of wire clips having at least one pusher located therebetween, the contact penetrating clip being capable of being removably coupled to the external housing, wherein once the contact penetrating clip is coupled to the external housing, the at least one pusher positions the first electrical wire and the second electrical wire to have an insulative coating of the first electrical wire and the second electrical wire cut by a cutter operably coupled to the apparatus thereby establishing an electrical connection between the apparatus and the first electrical wire and the second electrical wire;

a processor capable of being connected to a wireless network, a computer readable storage medium storing one or more programs for execution by the processor;

at least one barrier capable of being positioned in an open and/or closed position, wherein the at least one barrier is capable of being controlled by the apparatus; and at least one electronic device capable of establishing a wireless connection with the apparatus, wherein the apparatus is capable of sending alerts to the at least one electronic device, and wherein the electronic device is capable of sending a first signal to the apparatus thereby causing the a change in the state of the barrier.

8. The system of claim 7 further comprising at least one remote monitoring apparatus, wherein the remote monitoring apparatus has at least one accelerometer and is capable of communicating with the apparatus and/or electronic device.

9. The system of claim 7 wherein the at least one barrier is a garage door.

10. The system of claim 7 wherein the apparatus has an internal real time clock.

11. The system of claim 10 wherein the internal real time clock automatically changes the position between the open and closed position of the at least one barrier.

12. The system of claim 7 wherein a polarity of the first electrical wire and the second electrical wire comprising the signal and ground is determined automatically by the apparatus.

13. A method of using an apparatus, the method comprising the steps of:

placing the apparatus of claim 1 between a first electrical wire and a second electrical wire and a coupling surface;

positioning the first electrical wire and the second electrical wire in at least one dummy wire post;

depressing and securing a contact penetrating clip to the apparatus, wherein the depressing and securing of the contract penetrating clip cuts an insulative material covering the first electrical wire and the second electrical wire causing the apparatus and the first electrical wire and the second electrical wire to establish an operable electrical connection; and sending a first signal to the apparatus, wherein the first signal causes the apparatus to activate a first response of a device operably coupled to the first electrical wire and the second electrical wire.

14. The method of claim 13 wherein the first signal is a wireless protocol signal implementing at least 128-bit encryption.

15. The method of claim 13 wherein the apparatus is coupled to the first electrical wire and the second electrical wire in operable connection with a thermostat, security system, garage door, doorbell, motion detector, smoke detector, light detector, carbon monoxide detector, or natural gas detector, or any combination thereof.

16. The method of claim 13 further comprising the step of:

sending a second signal from the apparatus to a wireless receiver operably coupled to the apparatus.

17. The method of claim 15 wherein the apparatus is operably coupled with the garage door and a position of the garage door is electronically recorded and stored by the apparatus.

18. The method of claim 13 wherein time and date stamps are recorded by the apparatus in response to the apparatus receiving the first signal.

19. The method of claim 16 wherein the wireless receiver is an electronic device.

20. The method of claim 18 wherein the time stamps and date stamps are forwarded to the wireless receiver.

* * * * *